US008111018B2

(12) United States Patent
You

(10) Patent No.: US 8,111,018 B2
(45) Date of Patent: Feb. 7, 2012

(54) APPLICATION INFRASTRUCTURE FOR CONSTRUCTING ILLUMINATION EQUIPMENTS WITH NETWORKING CAPABILITY

(75) Inventor: Tung-Hsin You, Taipei (TW)

(73) Assignee: Evercomm Opto Ltd., Taipei (TW)

( * ) Notice: Subject to any disclaimer, the term of this patent is extended or adjusted under 35 U.S.C. 154(b) by 414 days.

(21) Appl. No.: 12/318,485

(22) Filed: Dec. 30, 2008

(65) Prior Publication Data

US 2010/0164386 A1 Jul. 1, 2010

(51) Int. Cl.
*H05B 37/02* (2006.01)

(52) U.S. Cl. ..... 315/308; 315/129; 315/158; 315/312

(58) Field of Classification Search ..... 315/129, 315/149–159, 291, 307–308, 312
See application file for complete search history.

(56) References Cited

U.S. PATENT DOCUMENTS 5,397,963 A * 3/1995 Manson ..... 315/129
7,109,668 B2 * 9/2006 Pogodayev et al. ..... 315/307
7,190,126 B1 * 3/2007 Paton ..... 315/308
7,429,828 B2 * 9/2008 Cleland et al. ..... 315/157
7,812,549 B2 * 10/2010 Yuen ..... 315/291
2002/0140379 A1 * 10/2002 Chevalier et al. ..... 315/291
2003/0209999 A1 * 11/2003 Hui et al. ..... 315/294
2008/0111498 A1 * 5/2008 Budike ..... 315/291
2009/0001893 A1 * 1/2009 Cleland et al. ..... 315/151
2009/0051300 A1 * 2/2009 Deppe et al. ..... 315/307

* cited by examiner

*Primary Examiner* — Tung X Le
(74) *Attorney, Agent, or Firm* — Rosenberg, Klein & Lee

(57) ABSTRACT

An application infrastructure for constructing illumination equipments with a transmission function includes at least one lamp reporting device for reporting a lamp condition, at least one lamp detection and transmission module with a two-way communication function, at least one message transmission and receiving module coupled to a control system, and a main system. Through a built-in wireless network or a power line network function of the illumination equipments, data can be transmitted among nodes of a mixed routing by indoor lighting having a transmission function and outdoor road lamps having a transmission function, without the need of building a basic network structure. A special network structure connecting the nodes to form lines and planes constitutes the application platform for constructing the illumination equipments with a two-way transmission function.

2 Claims, 6 Drawing Sheets

APPLICATION INFRASTRUCTURE FOR CONSTRUCTING ILLUMINATION EQUIPMENTS WITH NETWORKING CAPABILITY

BACKGROUND OF THE INVENTION

1. Field of the Invention

The present invention relates to an application infrastructure for constructing illumination equipments with a networking capability, and more particularly to an application infrastructure capable of constructing a two-way communication for illumination equipments by connecting nodes of a mesh routing network from lines into planes by means of the mesh data communication via wireless transmission or power line modem transmission. Using the built-in wireless network or a power line network of the illumination equipments either built-in indoor lights or outdoor street lights with a transmission function, can easily build the infrastructure of network communications without the need of constructing a traditional network structure.

2. Description of the Related Art

In general, present indoor lighting or outdoor lighting does not need any control unit, a switch for power ON/OFF is enough for the current lighting. As the public street lights, the determination of the lighting status will be checked by turning on all the street lights then visually checked by maintenance engineers in daytime. Once we built more and more clean energy power plants for application in our daily life, an effective way of using energy will be an important issue. Since the electricity storage of solar and wind energies is unlike the burning generated energy that can be predicted, but is affected by factors such as light intensity, wind speed and sun shine time duration. Therefore, an automatic reporting system is required for improving the overall investment and energy efficiency, regardless of the resources come from burning power plant or clean power plant, and whenever high energy efficiency is required. In existing power plant system, electric power produced by burning or clean energy will be mixed up, and then supplied to end users. In the mean time users cannot choose types of energy sources. If we want to classify and manage different energy sources, the power suppliers have to create a management network to complete the new requirement in the future. If we can make use of the design of a reporting system not only performing a self-test for the whole system to check its normal operation, but also self detecting the capacity of a battery level to determine whether or not to consume electric power at a particular time, such arrangement provides sufficient illumination continuously for a required number of hours and also allows a control center to know about the electric power storage situation to allow the overall allocation of an electric power source and determine when to increase the production of electric power. Without such arrangement, a fixed quantity of electric power will be consumed, but the consumption of electric power supplied for a certain time is not calculated. As a result, the street lights are lighted, but there is no way to predict when the light will go out. People keep building power plants to satisfy a periodically insufficient electric power, and it will incur wastes of investment and energy consumption rate.

In view of the shortcomings of the prior art, the inventor of the present invention based on years of experience in the related industry to conduct extensive researches and developments, and finally developed an application infrastructure for constructing illumination equipments with a transmission function in accordance with the present invention to overcome the shortcomings of the prior art.

SUMMARY OF THE INVENTION

Therefore, it is a primary objective of the invention to provide an application infrastructure for constructing illumination equipments with a networking capability, wherein a low-cost control device is installed to the illumination equipments or lamps. The present invention comprises: at least one lamp reporting device for reporting a lamp status, at least one lamp detection and transmission module with a two-way communication function, at least one message transmission and receiving module coupled to a control system, and a main system. Through a built-in wireless network or a power line modem network function of the lighting equipments, data can be transmitted among nodes of a mixed routing by indoor lighting with transmission capability and outdoor street light with transmission capability, without the need of building a basic network structure. A special network structure connecting the nodes to form lines and planes constitutes the application infrastructure for constructing the illumination equipments with a two-way communication capability.

In recent years, T5 energy-saving fluorescent lamps containing solid mercury has less pollution to the environment than T8 fluorescent lamps containing liquid mercury and the advantages of saving energy by 40% and producing a low temperature of only 40° C. of the lamp. Unlike the T8 fluorescent lamp having a temperature of over 60° C., the T5 fluorescent lamps are widely used by public and private sectors, and are used in different applications for energy saving and carbon reduction. Light emitting diode (LED) is developed for different areas of applications. Unlike general incandescent bulbs, the LED is a cold fluorescent lamp, and thus it has the advantages of low power consumption, long component life, no idling time requirement and quick response speed. In addition, LED comes with a small size and a good shock resistance for mass production, and thus LED can be assembled easily to meet the requirements in a small size or matrix capable components. The LED has been used extensively as indicating lamps in information technology devices, communication appliance and consumer electronic products and display devices, and the development of high power LED in street light and primary illuminations are growing quickly. Therefore, the present invention combined with the T5 energy-saving fluorescent tube or LED lightings can maximize the effects of protecting environment and saving energy.

The present invention adds the data communication technology via wireless transmission or power line communication to all lamps, regardless indoor or outdoor lamps, for controlling each group or individual of the lighting devices. For instance, the brightness of the lamp is controlled and fine-tuned according to the battery capacity of the illumination equipment at that time, so that the lighting efficiency of the energy source for the illumination equipments can be maximized. Or the device control signal transmitted from and passed through a communication enabled lighting device is used for reporting to a main system that control and monitor the devices, wherein the main system can be a system unit comprised of a microprocessor with a display device or a general computer with a monitor. Or using the characteristic of a mesh networking in the communication enabled lighting devices to form a networking environment, so that many value-added applications can be applied to the infrastructure of the lighting devices of the present invention. For example, the present invention can be applied to advertising sectors flexibly and effectively, such as a regional advertising can be applied once a recognized wireless device is passing by, and may either show advertisement in the LED panel or other electronic media. Or we can bright the street light in different time sections with different level brightness of the lamp.

Therefore, any wireless module or power line modem installed on the lamp that can be used for transmitting or receiving data and form a two-way communication networking environment, and such application can be used in our daily life is declared in present invention.

To make it easier for our examiner to understand the advantages, objects, and effects of the present invention, preferred embodiments together with related drawings are used for illustrating the invention as follows.

With reference to FIGS. 1 to 3 for, an application infrastructure for constructing illumination equipments with a transmission function, the application infrastructure comprises: at least one lamp reporting device 10 for reporting a lamp status, at least one lamp detection and transmission module 20 having a two-way communication function, at least one message transmission and receiving module 30 coupled to a control system, and a main system 40.

The lamp reporting device 10 is a device coupled to a lamp for providing related data including a current consumption of the lamp, a power level of the lamp or an external temperature value and a received power value for controlling the brightness of the lamp.

The lamp detection and transmission module 20 comprises:

a two-way wireless transceiver 21, for receiving and transmitting an instruction and a signal sent by a control system or another lamp detection and transmission module to the lamp detection and transmission module, or passing the instruction to the next lamp detection and transmission module, or actively reporting the operation of the lamp and its peripheral equipments;

a microprocessor 22, for interpreting the instruction and signal received by the two-way wireless transceiver 21, and verifying whether or not the signal comes from an authorized source; if the signal is targeted for this lamp detection and transmission module, then the signal will be transmitted to a driver of a lamp monitoring device 23, and if the signal is targeted for another lamp detection and transmission module, then the signal will be discarded and nothing will be done; and a lamp monitoring device 23, for detecting or controlling a signal monitoring device of a lamp; wherein the message transmission and receiving module 30 further comprises:

a two-way wireless transceiver 31;

a microprocessor 32, for encrypting and processing the content of a received message, and then transmitting the content to the main system 40 from the two-way wireless transceiver 31, or from a power line modem module 33 or a wireless module 34;

a power line modem module 33 and a wireless module 34, for receiving the content of a signal through a power cable or a wireless transmission; and a main system 40, for serving as a human-machine interface communication tool, and comprising:

an industrial computer, a main system screen wall or control screen, for displaying a figure of showing all illumination equipments in the system and distinguishing the most recent condition by color; and an application system software, provided for operator to define the illumination equipments and the required information, or determine the display interface, so as to provide a user-friendly interface for the operators in this lighting devices linked networking system.

In FIG. 4, the lamp detection and transmission module 20 further comprises:

a two-way power line modem transceiver 24, for receiving and transmitting an instruction and a signal transmitted from a control system or another lamp detection and transmission module to this lamp detection and transmission module, or passing the instruction to the next lamp detection and transmission module, or actively reporting the operation status of the lamp and its peripheral equipments;

a microprocessor 22, for interpreting the instruction and signal received by the two-way power line modem transceiver 24, and verifying whether or not the signal comes from an authorized source; if the signal is provided for this lamp detection and transmission module, then the signal will be transmitted to a driver of a lamp monitoring device 23; and if the signal is provided for an other lamp detection and transmission module, then the signal will be discarded, and nothing will be done; and a lamp monitoring device 23, for detecting or controlling a signal monitoring device of a lamp.

In FIG. 5, the message transmission and receiving module 30 further comprises:

a two-way power line modem transceiver 35;

a microprocessor 32, for encrypting and processing the content of a received message, and then transmitting the content to a main system 40 by the two-way power line modem transceiver 35, or by a power line modem module 33 or a wireless module 34; and a power line modem module 33 and a wireless module 34, for receiving the content of a signal through a power line or a wireless transmission.

DETAILED DESCRIPTION OF THE PREFERRED EMBODIMENTS

Figure 1:
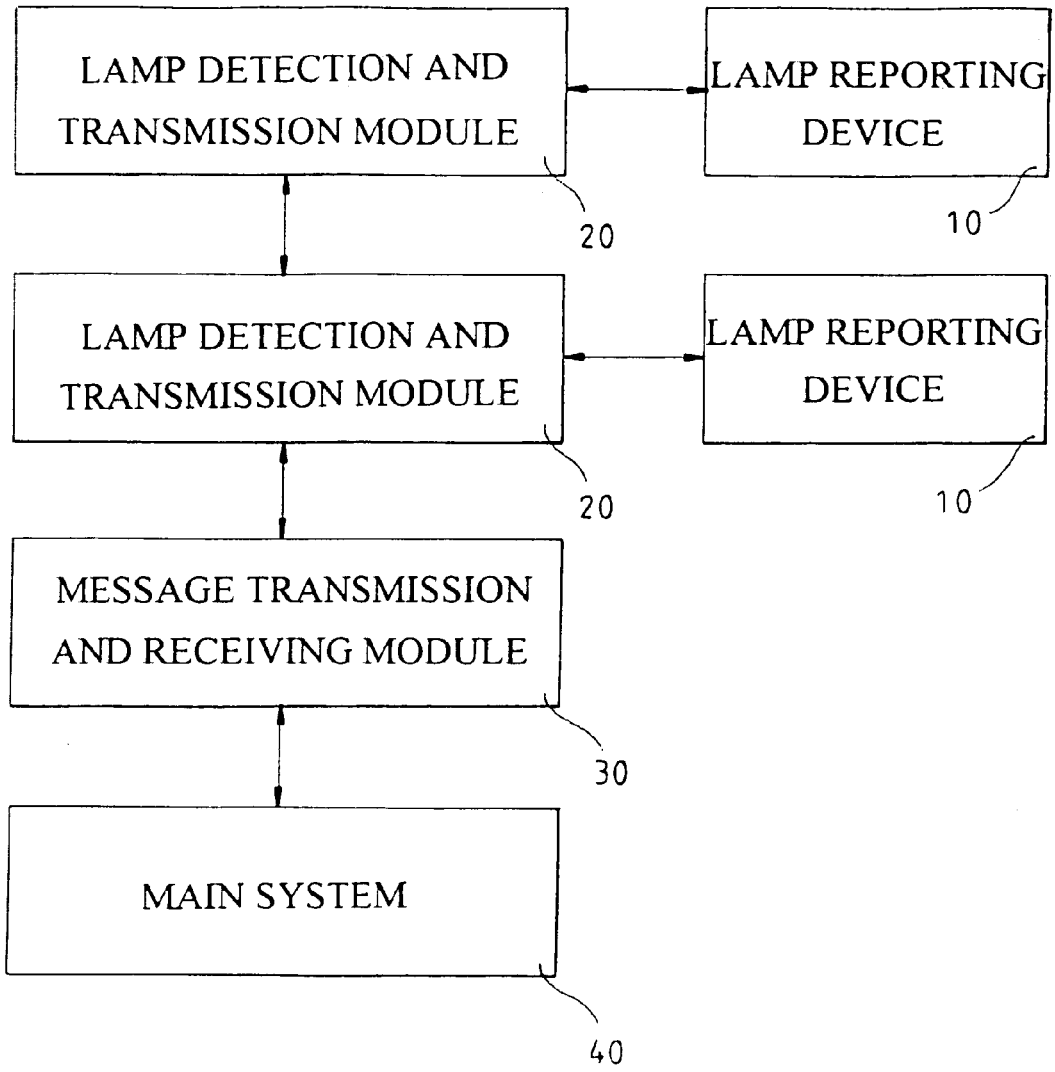
FIG. 1 is a schematic view of an overall structure of the present invention.
Figure 2:
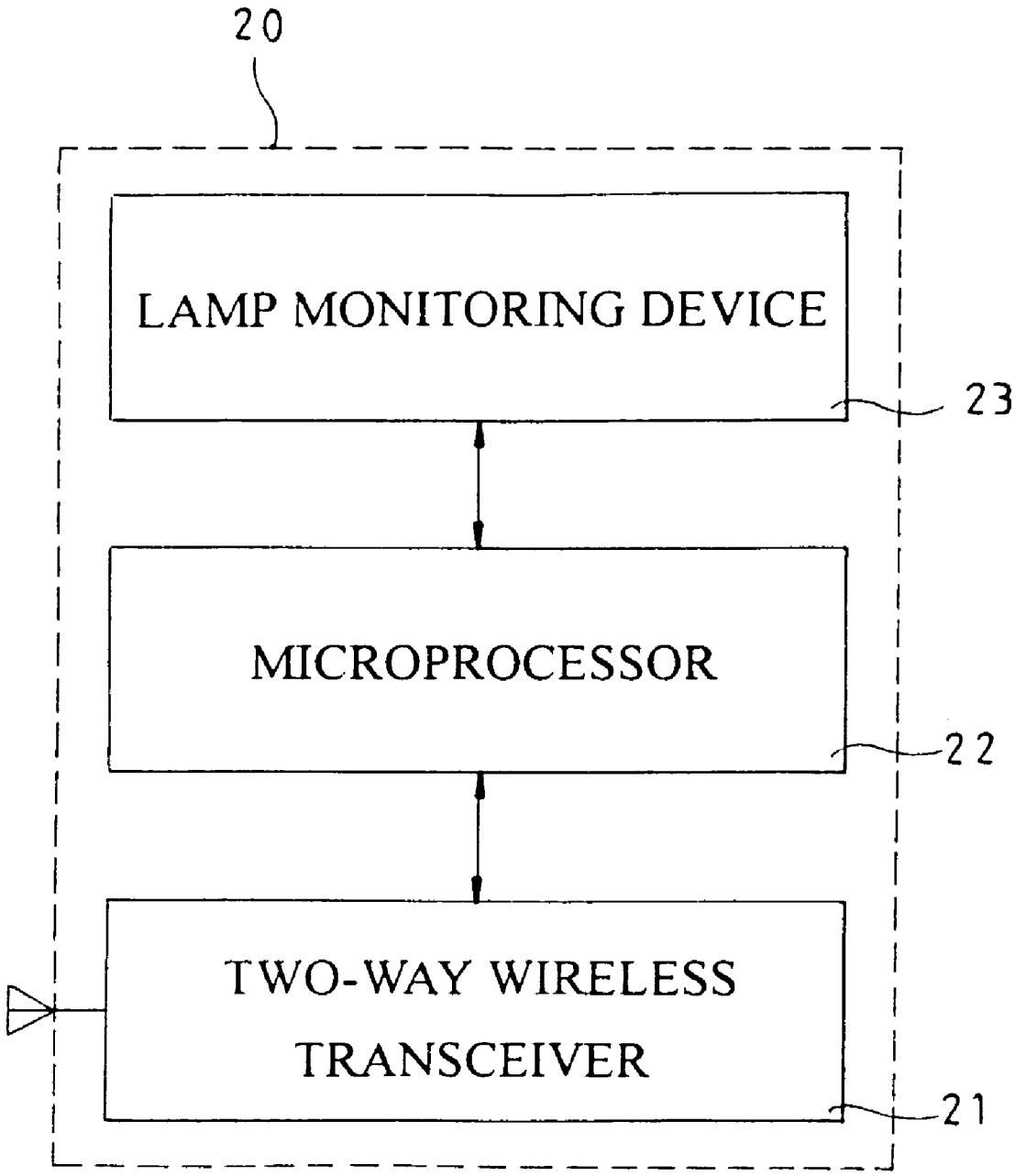
FIG. 2 is a schematic view of a set of components of a lamp detection and transmission module 20 in accordance with the present invention.
Figure 3:
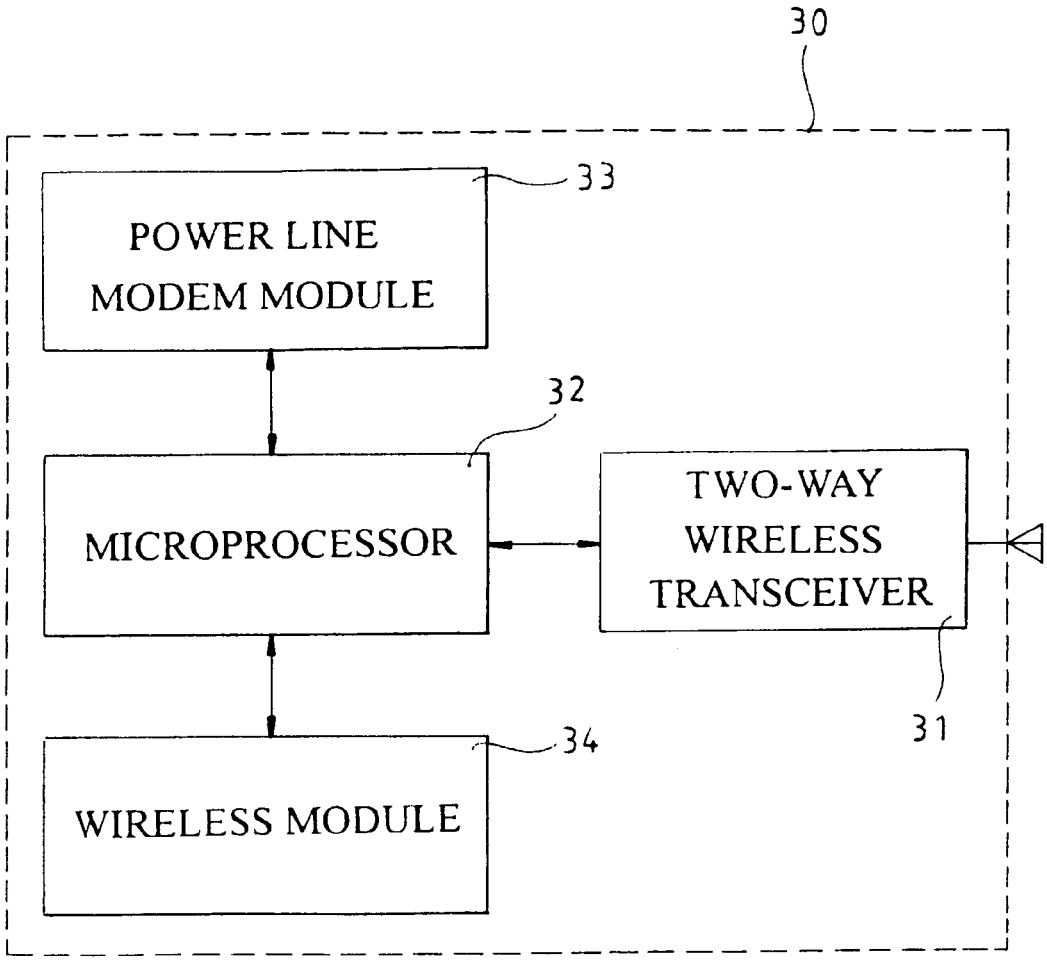
FIG. 3 is a schematic view of a set of components of a message transmission and receiving module 30 in accordance with the present invention.
Figure 4:
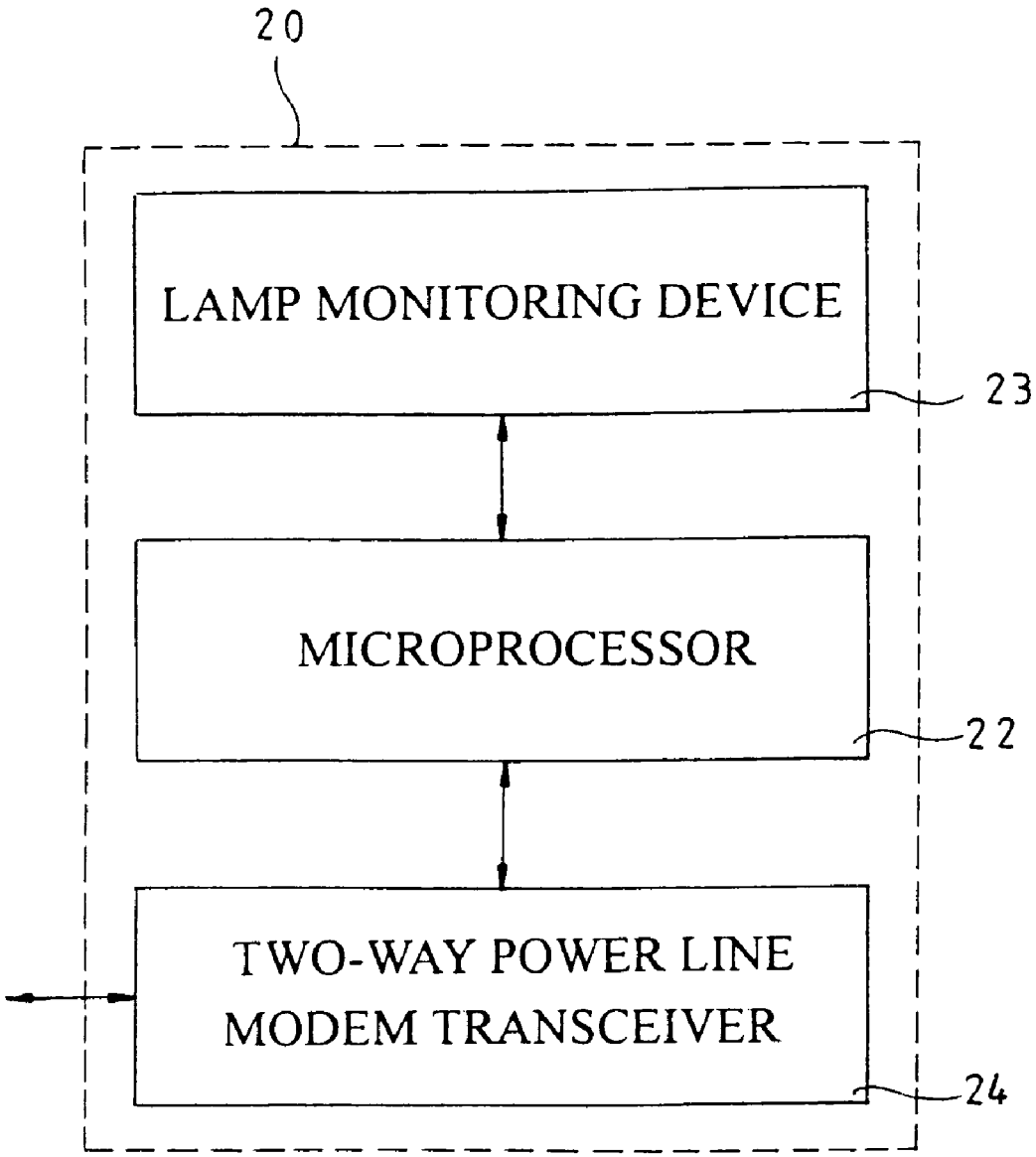
FIG. 4 is a schematic view of another set of components of a lamp detection and transmission module 20 in accordance with the present invention.
Figure 5:
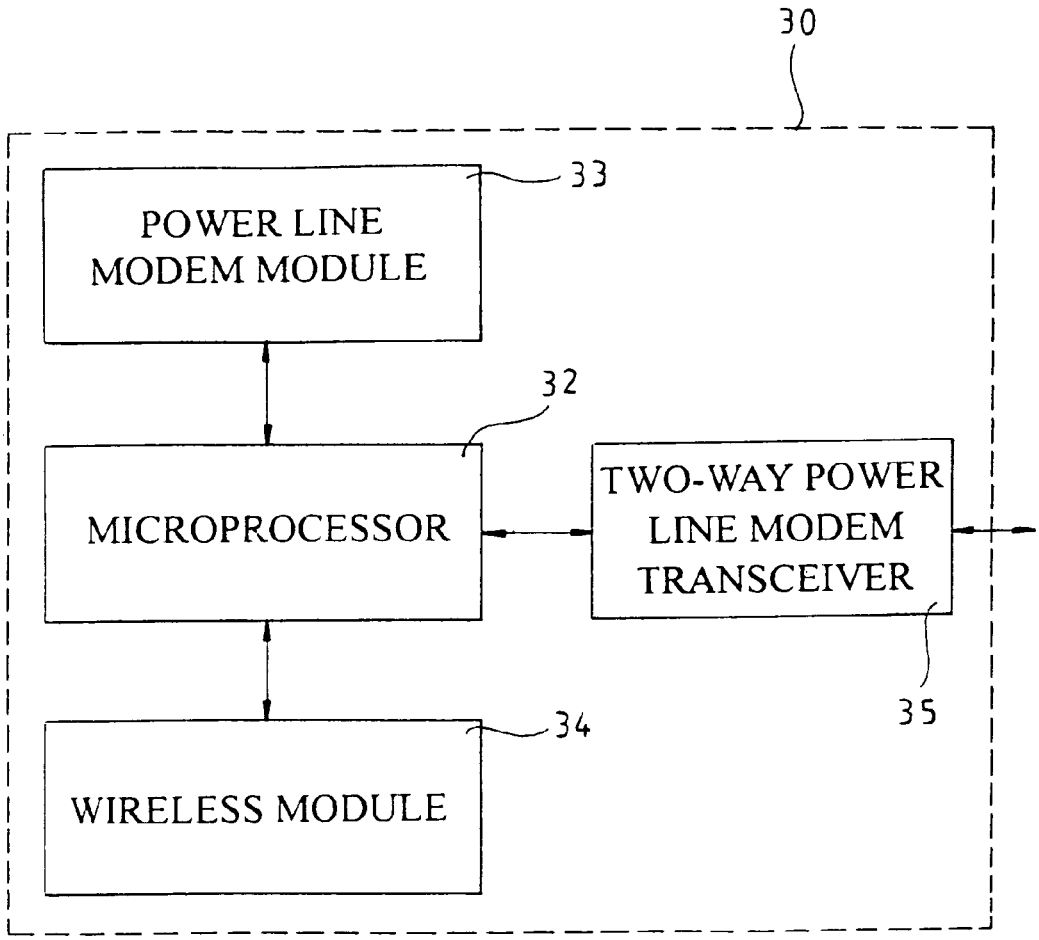
FIG. 5 is a schematic view of another set of components of a lamp detection and transmission module 20 in accordance with the present invention.

With the present invention composed of the aforementioned components, the main control system 40 will transmit an instruction to the power line modem module 33 or the wireless module 34 of the message transmission and receiving module 30 to command all lamps or certain specific lamps to report the current status of each devices and transmit back to the main control system 40 after a certain period of time. After the main system 40 receives the instruction and the microprocessor 32 encrypts and processes the received instruction, a signal will be transmitted by the two-way wireless transceiver 31 or the two-way power line modem transceiver 35. After the two-way wireless transceiver 21 or the two-way power line modem transceiver 24 of the lamp detection and transmission module 20 receives the signal, the signal will be passed to the next node, and this instruction will be determined whether or not it is related to this lamp detection and transmission module; if yes, then the microprocessor 22 will decrypt the instruction and confirm whether or not this instruction is authorized after the confirmation takes place, and the lamp monitoring device 23 will collect related information of the lamp according to the instruction and return the related information of the lamp to the main control system 40.

If an instruction transmitted from the main system 40 for detecting the current and temperature of a lamp and the operation condition of a power supply device is received, then a message for reading the status of the lamp will be transmitted, and then the message will be returned to the main system, and the current status of the lamp is displayed on a control console of the main system control center. If an instruction of adjusting the brightness of the lamp is received, then the controller will issue an instruction to change the brightness of the lamp according to the instruction, and the battery level of the illumination equipments is used for controlling and fine-tuning the brightness of the lamp, so that the efficiency of the battery capacity can be maximized.

The present invention can also be applied to a location based application in home health care, which is an important application in the future. At present, broadband network is mainly used for transmitting data for the home health care purpose, but such application will not be available if a user does not have applied any internet service at home.

Figure 6:
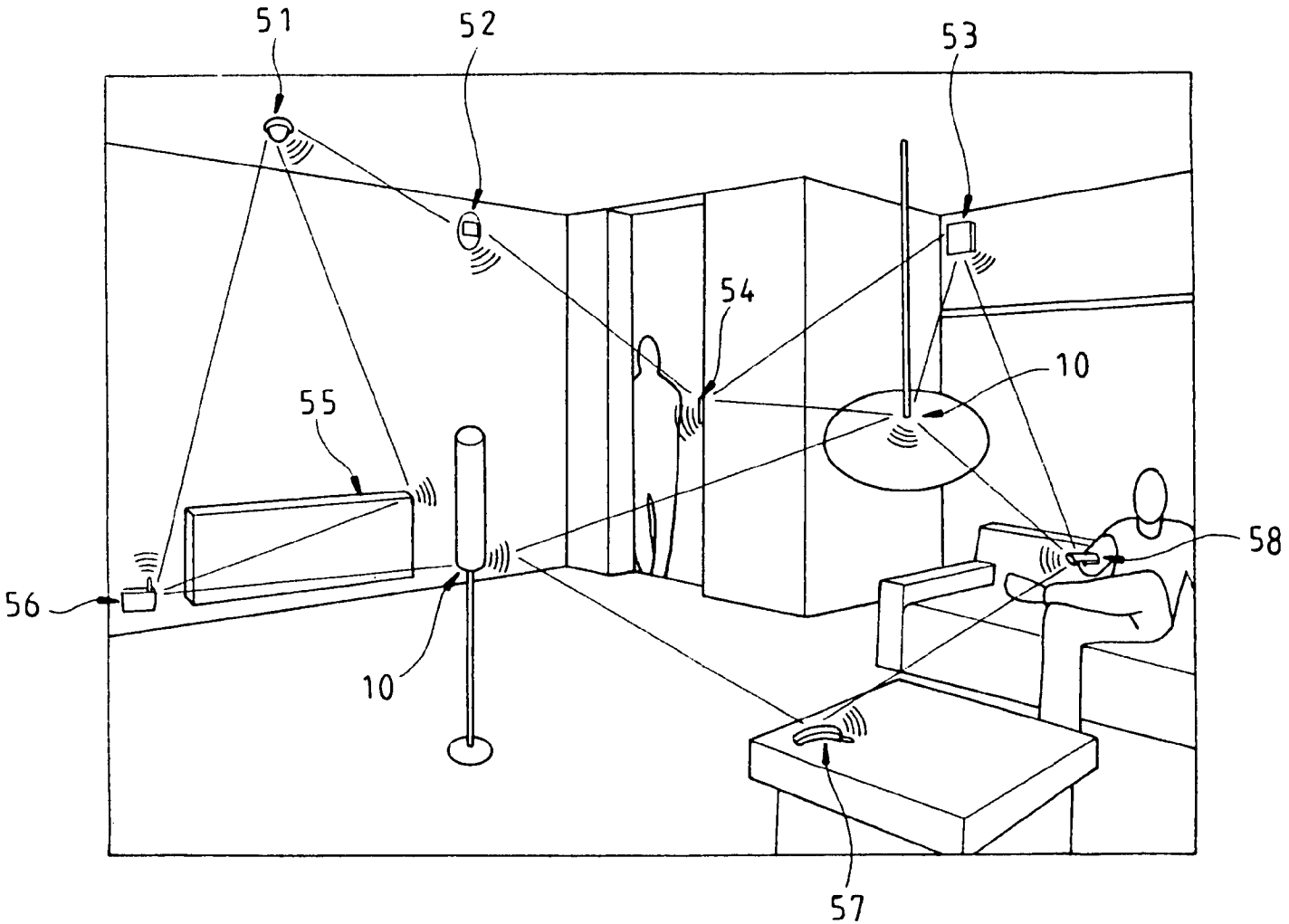
FIG. 6 is a schematic view of an application of a preferred embodiment of the present invention.

With reference to FIG. 6, if a person enters a room through an access controller 54 at the door, the access controller 54 will receive related information, and transmit a signal to the lamp reporting device 10, and the movement detector 52 will detect the person entering into the room and will also transmit a signal to the lamp reporting device 10. After the lamp reporting device 10 received the signal from the movement detector 52, a trigonometric positioning method is used for locating the exact position of the person, or after a signal is received from various different electric appliances such as a safety alarm 51, a window controller 53, an air conditioner 55, a modem 56, a telephone 57, and a remote controller 58, the signal will be transmitted to the lamp reporting device 10 and then to the main system of a control center to serve as a basis for processing and executing each follow-up service.

With the characteristic of a mesh network formed by communication enabled lighting devices in accordance with the present invention, a protection network for home health care can be established quickly, while a location based application can be added to the network infrastructure, such that if an elderly or a patient is missing or leaves a caring range, the actual instant situation can be alerted and handled easily and quickly, so that the elderly or patient at home can be protected and taken care immediately.

The present invention can be further applied to an Automatic Meter Reading (AMR) system. For systems like this, the telecommunication companies usually use GPRS, 3G or WiMax as a communication medium. This kind of system builds many base stations and the base stations are used as a collection node for transmissions, but such arrangement will incur a high cost and is not cost-effective. With the characteristic of the mesh network by using communication enabled lighting devices, the same purpose can be achieved. Since the lamps already have built in the function of a wireless network or a power line transmission network, therefore it incurs no additional cost for the infrastructure. In the meantime, each user has lamps in the room already, and thus it simply needs installing a control device to connect the nodes, and also connect the outdoor street lights into a line and a plane to form a special network structure. With the application infrastructure for constructing illumination equipments with a transmission function, we can achieve the application for system without the need of human reading meters.

While the invention has been described by means of specific embodiments, numerous modifications and variations could be made thereto by those skilled in the art without departing from the scope and spirit of the invention set forth in the claims.

In summation of the description above, the present invention improves over the prior art, and complies with the requirements of patent application, and thus is duly filed for patent application.

What is claimed is:

1. An application infrastructure for constructing illumination equipment with a network capability, comprising: at least one lamp reporting device for reporting a lamp status, at least one lamp detection and transmission module having a two-way communication function, at least one message transmission and receiving module coupled to a control system, and a main system, characterized in that:

the lamp reporting device is a device coupled with a lamp for providing lamp operating data;

the lamp detection and transmission module comprises:

a two-way wireless transceiver, for receiving and transmitting an instruction and a signal transmitted from the control system or another lamp detection and transmission module to the lamp detection and transmission module, or passing the instruction down to a next lamp detection and transmission module, or actively reporting an operation condition of the lamp and its peripheral equipment;

a microprocessor, for interpreting an instruction and a signal received by the two-way wireless transceiver, and verifying that the received signal comes from an authorized source; if the signal is provided for the lamp detection and transmission module, then the signal is transmitted to a driver of a lamp monitoring device; and if the signal is provided for another lamp detection and transmission module, then the signal is discarded;

the lamp monitoring device, for detecting or controlling a signal monitoring device of the lamp;

the message transmission and receiving module, comprising:

a two-way wireless transceiver;

a microprocessor, for receiving a message content, encrypting and processing the message content, and transmitting the message content from the two-way wireless transceiver or transmitting the message content from a power cable module or a wireless module to the main system;

a power line modem module and the wireless module, for receiving a signal content via a power line or a wireless transmission;

the main system, issuing an instruction to the power line modem module or the wireless module of the message transmission and receiving module to command all illumination equipments or certain specific illumination equipment to report the current status of the main control system, and after the main system receives the instruction and the microprocessor encrypts and processes the instruction, the two-way wireless transceiver transmits a signal; after the two-way wireless transceiver of the lamp detection and transmission module receives the signal, the signal is transmitted to a next node immediately, while the instruction is considered and determined that the instruction is related to the lamp detection and transmission module; if the instruction is related, then the microprocessor decrypts the instruction and confirms that the instruction is authorized, and after the confirmation takes place, the lamp monitoring device is configured to collect information of the lamp according to the instruction and the signal, and then return the information to the main control system, and display the current status of the lamp on the main system, and if an instruction for adjusting the data of each illumination equipment, the controller is configured to issue an instruction for performing the control;

by means of the characteristic of mesh network by using communication enabled lighting devices for transmitting data via a wireless transmission, and the illumination equipment having a wireless network function built in, and indoor lighting having a transmission function and outdoor street light having the transmission function being connected into a special network infrastructure from mesh network by using communication enabled lighting devices of a mixed routing to form a line or a plane, to constitute the application infrastructure of constructing a two-way transmission of the illumination equipment.

2. An application infrastructure for constructing illumination equipment with a transmission function, comprising: at least one lamp reporting device for reporting a lamp status, at least one lamp detection and transmission module having a two-way communication function, at least one message transmission and receiving module coupled to a control system, and a main system, characterized in that:

the lamp reporting device is a device coupled with a lamp for providing lamp operating data;

the lamp detection and transmission module comprises:

a two-way power line transceiver, for receiving and transmitting an instruction and a signal transmitted from the control system or another lamp detection and transmission module to the lamp detection and transmission module, or passing the instruction down to a next lamp detection and transmission module, or actively reporting an operation condition of the lamp and its peripheral equipment;

a microprocessor, for interpreting an instruction and a signal received by the two-way power line modem transceiver, and verifying that the received signal comes from an authorized source; if the signal is provided for the lamp detection and transmission module, then the signal is transmitted to a driver of a lamp monitoring device; and if the signal is provided for another lamp detection and transmission module, then the signal is discarded;

the lamp monitoring device, for detecting or controlling a signal monitoring device of the lamp;

the message transmission and receiving module, comprising:

a two-way power line modem transceiver;

a microprocessor, for receiving a message content, encrypting and processing the message content, and transmitting the message content from the two-way power line modem transceiver or transmitting the message content from a power line module or a wireless module to the main system;

the power line modem module and the wireless module, for receiving a signal content via a power line or a wireless transmission;

the main system, issuing an instruction to the power line modem module or the wireless module of the message transmission and receiving module to command all illumination equipment or certain specific illumination equipments to report the most recent condition of the main control system, and after the main system receives the instruction and the microprocessor encrypts and processes the instruction, the two-way power line modem transceiver transmits a signal; after the two-way power line modem transceiver of the lamp detection and transmission module receives the signal, the signal is transmitted to a next node immediately, while the instruction is considered and determined that the instruction is related to the lamp detection and transmission module; if the instruction is related, then the microprocessor decrypts the instruction and confirm that the instruction is authorized, and after the confirmation takes place, the lamp monitoring device is configured to collect information of the lamp according to the instruction and the signal, and then return the information to the main control system, and display the most recent condition of the lamp on the main system, and if an instruction for adjusting the data of each illumination equipment, the controller is configured to issue an instruction for performing the control;

by means of the characteristic of mesh network by using communication enabled lighting devices for transmitting data via power line, and the illumination equipment having a wireless network function built in, and indoor lamps having a transmission function and outdoor street light having the transmission function being connected into a special network structure from node to node of a mixed routing to form a line or a plane, to constitute the application platform of constructing a two-way transmission of the illumination equipment.

* * * * *